US010577903B2

(12) United States Patent
Green et al.

(10) Patent No.: US 10,577,903 B2
(45) Date of Patent: Mar. 3, 2020

(54) VORTEX PLUNGER ARRANGEMENT

(71) Applicants: David A. Green, Highlands Ranch, CO (US); Robert E. Bender, Evergreen, CO (US); Daniel J. Nelson, Lakewood, CO (US)

(72) Inventors: David A. Green, Highlands Ranch, CO (US); Robert E. Bender, Evergreen, CO (US); Daniel J. Nelson, Lakewood, CO (US)

(73) Assignee: Wellmaster Corp, Golden, CO (US)

( * ) Notice: Subject to any disclaimer, the term of this patent is extended or adjusted under 35 U.S.C. 154(b) by 776 days.

(21) Appl. No.: 15/330,275

(22) Filed: Sep. 1, 2016

(65) Prior Publication Data

US 2017/0101856 A1 Apr. 13, 2017

Related U.S. Application Data

(63) Continuation-in-part of application No. 13/999,272, filed on Feb. 4, 2014, now Pat. No. 9,121,269.

(60) Provisional application No. 62/283,466, filed on Sep. 1, 2015.

(51) Int. Cl.

| | |
|---|---|
| ***E21B 43/12*** | (2006.01) |
| ***F04B 47/12*** | (2006.01) |
| ***E21B 47/01*** | (2012.01) |

(52) U.S. Cl.

CPC ..... *E21B 43/121* (2013.01); *E21B 47/01* (2013.01); *F04B 47/12* (2013.01)

(58) Field of Classification Search

USPC ..... 166/105, 372

See application file for complete search history.

(56) References Cited

U.S. PATENT DOCUMENTS

| | | | | |
|---|---|---|---|---|
| 4,629,004 A * | 12/1986 | Griffin | F04B 47/12 | 166/170 |
| 5,435,628 A * | 7/1995 | Montgomery | E21C 25/60 | 175/212 |
| 6,776,247 B1 * | 8/2004 | Bassal | E21B 17/22 | 175/325.4 |

* cited by examiner

*Primary Examiner* — Taras P Bemko
*Assistant Examiner* — Ronald R Runyan
(74) *Attorney, Agent, or Firm* — Don Halgren

(57) ABSTRACT

A plunger assembly arranged to minimize uneven wear spots or areas thereon during the plunger assembly's horizontal and vertical travel within a hydrocarbon producing well conduit. The plunger assembly comprises an elongated central mandrel having an elongated central bore extending longitudinally therethrough for transmitting fluids from a well through the plunger assembly, the elongated central mandrel having a generally cylindrically shaped outer surface along portions thereof, and a plurality of arcuately shaped wear pads guidedly supported on the cylindrically shaped outer portions of the central mandrel An array of elongated helically presented protrusions and a corresponding array of elongated helically presented grooves in mating interdigitation are arranged between the outer portions of the mandrel and their radially adjacent wear pads, so as to provide an inducement of rotation to the plunger assembly about its longitudinal axis during the plunger assembly's travel through a well conduit.

10 Claims, 7 Drawing Sheets

VORTEX PLUNGER ARRANGEMENT

The present application is based upon provisional application No. 62/283,466, which present application is a continuation-in-part application of Ser. No. 13/999,272 (Bender-26), now U.S. Pat. No. 9,121,269, each of which is incorporated herein by reference in its entirety.

BACKGROUND OF THE INVENTION

Field of the Invention

This application relates to plunger lift systems for oil and gas wells, and more particularly to a gas lift plunger with an improved assembly arrangement to facilitate liquid removal from inclined, S-shaped and or horizontal wells.

Discussion of the Prior Art

Directional drilling is a term to describe drilling of an oil or gas well such that the conduit to the producing zones may be reached more directly, more effectively and wherein such zones reached will be more productive. Directional drilling permits a multitude of wells to be drilled from a single "pad" to their endpoints deep in the ground and conform to well spacing requirements and regulations with minimal disturbance to the surface environments. In these cases, the well bore may take on sort of an "S" shape to reach a target endpoint which is likely offset from the drill site.

In other instances, directional drilling is used to drill the well bore to a desired depth, then steer the well bore to follow along a lateral path through a producing geologic formation. This is commonly referred to as a "Horizontal" well.

Well plungers have been utilized for many years in the recovery of gas and oil from vertical wells for the removal of liquids and to facilitate both hydrocarbon gas and liquid extraction from those wells. Plungers utilized in non-vertical and horizontal wells frequently encounter a wear problem, because the non-vertical portion of the well conduit may effect premature wear on one side portion of the plunger. A typical prior art plunger may thus have a wear spot on an underside thereof. Such wear spot disposed along its longitudinal axis will minimize the sealing capacity of the plunger within the well conduit, leaving fluid in the well which would have been lifted had the plunger remained round and not worn unevenly. After time the unevenly worn plunger will preferentially lie in the same axial orientation as it moves through the tubing string causing flattening of its underside due to increased friction between the plunger and the tubing wall as more of the weight of the plunger is brought to bear on one side of the plunger during its travel.

It is thus an object of the present invention to overcome the disadvantages of the prior art.

It is a further object of the present invention to provide a plunger arrangement which will function properly in both vertical and horizontal portions of a hydrocarbon well system.

It is a still further object of the present invention to provide a plunger system to handle curves and angles as typically found in horizontal wells and pad drilled "S" shaped wells without undue wearing or loss of plunger efficiency.

It is still another object of the present invention to provide additional means to induce rotation for the purpose of improving the wear life, particularly in inclined or horizontal wellbores, such additional means comprising rotating jets of fluid (gas or liquid) perpendicular (+/−20 degrees) to the longitudinal axis, for the purpose of creating an improved turbulent seal and thereby improving the liquid lifting capability of the tool, again particularly in inclined or horizontal wellbores.

It is another object of the present invention to provide means in a plunger to induce a rotating flow that exits the upper end of the plunger and conditions the flow above the plunger such that liquids are directed by centrifugal force towards the tubing wall, thereby providing a liquid film dispersed around the tubing wall which provides for a lower coefficient of friction and improved ability of the plunger to travel in the upward direction.

It is another object of the present invention to have "inlet ports" at or just above the narrow passageway to allow for the inward flow of fluid to the reduced cross-sectional area or the immediate vicinity of this restriction, to create a circulating flow to enhance aeration of the fluid exiting the upper exit of the plunger.

BRIEF SUMMARY OF THE INVENTION

The present invention comprises a split pad plunger for use in hydrocarbon wells, particularly those wells producing natural gas as the primary product. The split pad plunger assembly of the present invention is utilized to physically travel up and down between the top of the well to the bottom of the well and also travel any non-vertical or horizontal conduits of that well and back to drive the bulk of the liquid present in its travel conduit, to the surface.

The plunger assembly is comprised of an elongated hollow central core mandrel. The hollow central elongated core mandrel consists of an elongated at least partially hollow first or front upper half and elongated fully hollow second back (lower) half with a bore extending therethrough. Each front half and the back half, at least in one preferred embodiment is preferably a duplicate of portions of the other half. The bore in a preferred embodiment is of uniform diameter along the length of its elongated longitudinal axis "L".

The bore extending through the mandrel in another preferred embodiment may be of narrowed "venturri-like" configuration. The taper of the bore would preferably be often narrowing diameter as the bore extends from the bottom of lower barrel and the plunger assembly towards the top or upper end thereof. The bore in a further embodiment may thus be "pinched" a narrowed diameter sections to have a venturri-like fluid flow effect on fluids passing through that bore.

The elongated hollow mandrel may have a mid-portion with an annular circumferential securement ring ridge disposed centrally therearound. The upper and lower half of the mandrel each have at least two sets of longitudinally spaced-apart radial arrays of supports for engagement of their respective plunger pads.

The plunger pads are of course of curvilinear shape so as to conform to the outer surface of the mandrel. The plunger pads are secured by adjacent annular members as identified and shown in the aforementioned U.S. Pat. No. 9,121,269, incorporated herein by reference. A compressive spring is positioned between the spring pockets and the inner surface of each respective plunger pad at the locus of the spring pocket.

In one preferred embodiment of the plunger assembly of the present invention, the mandrel has a bore extending from a 2nd or lower end to a 1st or upper end. The bore in a preferred embodiment has a reduced diameter portion arranged closely to its uppermost end. The bore in this embodiment has a rifling groove extending from the 2nd or lowermost end all away through to the 1st or uppermost end. This includes the portion of the bore with the produced diameter near the uppermost end.

A plurality of radially directed holes or bores in a further embodiment, may be arranged through the sidewall of the mandrel from the bore at the reduced diameter portion thereof. A plurality of tangentially directed holes or bores in yet another embodiment may be arranged through the sidewall of the mandrel from the bore at longitudinally spaced apart locations at the lower or 2nd end of the bore, near the midpoint longitudinally of the bore, and close to the upper end of the bore approaching the reduced to diameter thereof. Such tangentially directed holes or bores extending through the wall of the mandrel and not through one of the movable plunger pads attached thereto.

In one preferred embodiment of the plunger pads there are arranged at least one diagonally or angularly disposed groove or cut arranged across the inner side thereof. The diagonally disposed groove or cut may be of tapering depth across the length of that groove or cut going from a shallow end to a deeper end. Correspondingly, the peripheral outer surface of the mandrel will have an elongated diagonally arranged tapered protrusion thereon so as to engage the respective diagonally disposed groove or cut on its radially adjacent plunger pad. The purpose of these diagonally arranged protrusions and cuts is to further induce rotation of the plunger assembly about its longitudinal axis as the plunger assembly travels through a well by virtue of the fluid within the well engaging and effecting a biasing force on those diagonal members between the pads and the outer surface of the mandrel.

In yet another embodiment of the present invention, the central bore will have been uppermost end which stops short of the upper or 1st end of the mandrel. In this embodiment however multiple angled openings, preferably forming a helix extending from the uppermost end of the central bore and out through the wall of the mandrel in a direction towards the upper or 1st end of the plunger assembly.

The grooves or cuts arranged on the inner-mandrel-facing side of the plunger pads may in a further embodiment be of constant depth or they may be of tapering depth, and correspondingly arranged so to align with the radially adjacent spiral or helically or diagonally arranged correspondingly sized protrusions on the radially outer surface of the mandrel.

In yet a further embodiment of the present invention, the plunger pads themselves may have diagonally or helically arranged elongated angled protrusions extending radially outwardly from the inner surface of the respective pads. Those angled protrusions on the pads may be of the uniform height or may be of tapering height. The radially adjacent outer surface of the mandrel to which those particular plunger pads would be attached would have a corresponding diagonally or helically arranged cuts of corresponding depth so as to properly mate with their adjacent plunger pads.

These means are all arranged to induce rotation for the purpose of improving the wear life, particularly in inclined or horizontal wellbores, or additional means to create rotating wisps of gas or liquid fluids perpendicular or within + or −20° to the longitudinal axis "L" of the plunger assembly for the purpose of creating an improved turbulence seal and thereby improving the lifting capability of the tool especially in inclined or horizontal wellbores.

The present invention thus provides means to induce a rotating flow that exits the upper end of the plunger wherein conditions of the flow above the plunger are such that liquids are directed by centrifugal force toward the tubing wall, thereby providing a liquid film dispersed around the tubing wall which provides a lower coefficient of friction and an improved ability of the plunger to travel in an upward direction. Further, inlet ports at or just above the narrow passageway of the central bore may allow for the inward or outward flow of fluid to or from the reduced cross-sectional area or in the immediate vicinity of this restriction to create a circulating flow to enhance aeration of the fluid exiting from the upper exit end of the plunger.

The invention thus comprises a plunger assembly arranged to minimize uneven wear spots or areas thereon during the plunger assembly's horizontal and vertical travel within a hydrocarbon producing well conduit, the plunger assembly comprising: elongated central mandrel having a bore extending longitudinally therethrough for transmitting fluids from a well through the plunger assembly, the elongated central mandrel having a generally cylindrically shaped outer surface along portions thereof; a plurality of arcuately shaped wear pads guidedly supported in a spaced-apart manner on the cylindrically shaped outer portions of the central mandrel; and an array of elongated helically presented protrusions and a corresponding array of elongated helically presented grooves in mating interdigitation between the outer portions of the mandrel and the wear pads, so as to provide an inducement of rotation to the plunger assembly about its longitudinal axis during the plunger assembly's travel through a well conduit. The array of protrusions are arranged on the outer portions of the mandrel, and the corresponding array of grooves are arranged on the wear pads. The array of protrusions are arranged on the wear pads, and the corresponding array of grooves are arranged on the outer portions of the mandrel. The elongated protrusions may be of tapering height along their length. The elongated grooves may be of tapering depth along their length. The elongated protrusions and the elongated grooves have corresponding physical intermatable characteristics along their length.

The invention also comprises a plunger assembly arranged to minimize uneven wear spots or areas thereon during the plunger assembly's horizontal and vertical travel within a hydrocarbon producing well conduit, the plunger assembly comprising: an elongated central mandrel having an elongated central bore extending longitudinally therein for transmitting fluids from a well through the plunger assembly, the elongated central mandrel having a generally cylindrically outer wall member along portions thereof; an array of elongated helically arranged bores extending outwardly through the outer wall member of the elongated central mandrel at an upper end thereof, a flow of fluid therefrom during travel of the plunger assembly functioning as to provide an inducement of rotation to the plunger assembly about its longitudinal axis during that plunger assembly's travel through a well conduit. The central bore may extend only to a location spaced from the upper end of the elongated mandrel.

The invention also comprises a method of inducing rotation of a plunger assembly during the plunger assembly's movement through a conduit in a hydrocarbon well, comprising: arranging an elongated central mandrel having a bore extending longitudinally therethrough for transmitting gaseous fluids from a well through the plunger assembly, the elongated central mandrel having an outer wall with cylindrically shaped outer portions arranged longitudinally therealong; arranging a plurality of arcuately shaped wear pads guidably supported on outer portions of the elongated central mandrel; arranging a plurality of elongated helically configured protrusions and a plurality of elongated helically configured grooves in an intermating relationship between the wear pads and the cylindrically shaped outer portions of the elongated central mandrel to effect a biasing force thereon is fluid flows between the mandrel and wear pad so as to induce that rotation of the plunger assembly. The method may include one or more of the following: arranging the elongated helically configured protrusions on an inner surface of the wear pad; arranging the elongated helically configured grooves on the cylindrically outer portion of the elongated mandrel; arranging an elongated longitudinally directed central bore through the elongated mandrel; arranging an array of helically directed bores extending through the outer wall of the mandrel at an upper end of the elongated longitudinally directed central bore, wherein fluid from the central bore passes outwardly and upwardly through the array of helically directed bores towards the upper end of the plunger assembly; and arranging a helically directed crew along the entire length of the longitudinally directed central bore.

The invention also comprises a plunger assembly arranged to minimize uneven wear spots or areas thereon during the plunger assembly's horizontal and vertical travel within a hydrocarbon producing well conduit, the plunger assembly comprising: an elongated central mandrel having an elongated central bore extending longitudinally therethrough for transmitting fluids from a well through the plunger assembly, the elongated central mandrel having a generally cylindrically shaped outer surface along portions thereof; a plurality of arcuately shaped wear pads guardedly supported on the cylindrically shaped outer portions of the central mandrel; an array of elongated helically presented protrusions and a corresponding array of elongated helically presented grooves in mating interdigitation between the outer portions of the mandrel and the wear pads, so as to provide an inducement of rotation to the plunger assembly about its longitudinal axis during the plunger assembly's travel through a well conduit; and a helical groove arranged along the entire length of the elongated central bore, to further induce rotation of the plunger assembly about its longitudinal axis as fluid flows through that elongated central bore during travel of the plunger assembly through a well conduit. The outer surface of portions of the mandrel and the spaced-apart wear pads create a plunger assembly rotation-inducing fluid flow path therebetween because of interaction and biasing by the fluid flow against the protrusions extending between the wear pads and the mandrel.

BRIEF DESCRIPTION OF THE DRAWINGS

The objects and advantages of the present invention will become more evident, when viewed in conjunction with the following drawings, in which.

DETAILED DESCRIPTION OF THE PREFERRED EMBODIMENTS

Figure 1:
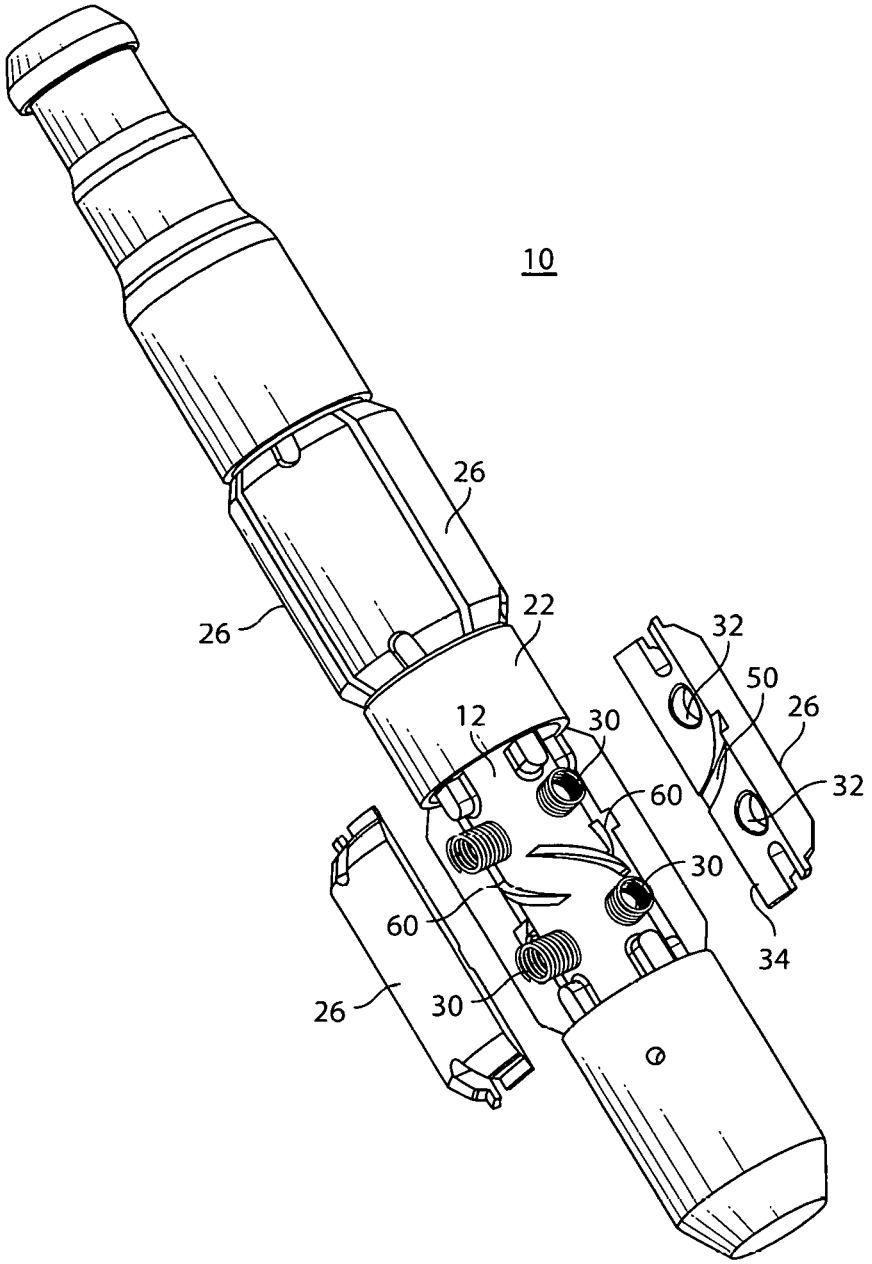
FIG. 1 is a perspective view of a plunger assembly constructed according to the principles of the present invention, with a partially exploded portion showing one embodiment of the plunger pads and the mandrel associated therewith.

Referring now to the drawings in detail, and particularly to FIG. 1, there is shown the present invention which comprises a split pad plunger assembly 10 for use in hydrocarbon wells, particularly those wells producing natural gas as the primary product. The split pad plunger assembly 10 of the present invention is utilized to physically travel up and down between the top of the well to the bottom of the well and also travel any non-vertical or horizontal conduits of that well and back to drive the bulk of the fluid/liquid present in its travel conduit, to the surface.

Figure 2:
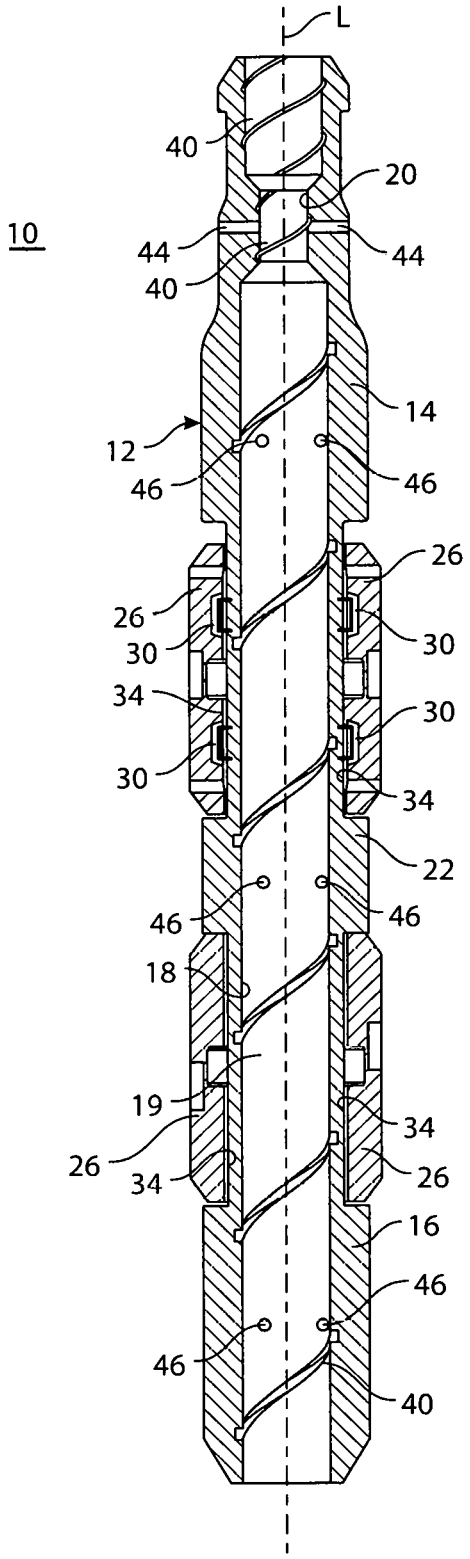
FIG. 2 is a longitudinal sectional view of a plunger constructed according to the embodiment shown in FIG. 1.

The plunger assembly 10 is comprised of an elongated hollow central core mandrel 12, shown more specifically in FIG. 2. The hollow central elongated core mandrel 12 consists of an elongated at least partially hollow first or front upper half 14 and elongated fully hollow second or lower half 16 with a bore 18 extending therethrough. Each upper or top half 14 and the lower or bottom half 16, at least in one preferred embodiment is preferably a duplicate of portions of the other half. The bore 18 in one preferred embodiment may be of uniform diameter along the length of its elongated longitudinal axis "L".

The bore 18 extending through the mandrel 12 in another preferred embodiment may have a narrowed diameter section as a "venturri-like" portion 20, as shown in FIG. 2. The taper of the bore 18 would preferably be often narrowing diameter as the bore extends from the bottom or lower barrel and the plunger assembly towards the top or upper end thereof.

The elongated hollow mandrel 12 may have a mid-portion with an annular circumferential securement ring ridge 22 disposed centrally therearound as represented in FIGS. 1, 2, 3 and 4. The upper and lower half 14 and 16 of the mandrel 12 each have at least two sets of longitudinally spaced-apart radial arrays of supports 24 for engagement of their respective circumferentially arranged plunger pads 26.

Figure 3:
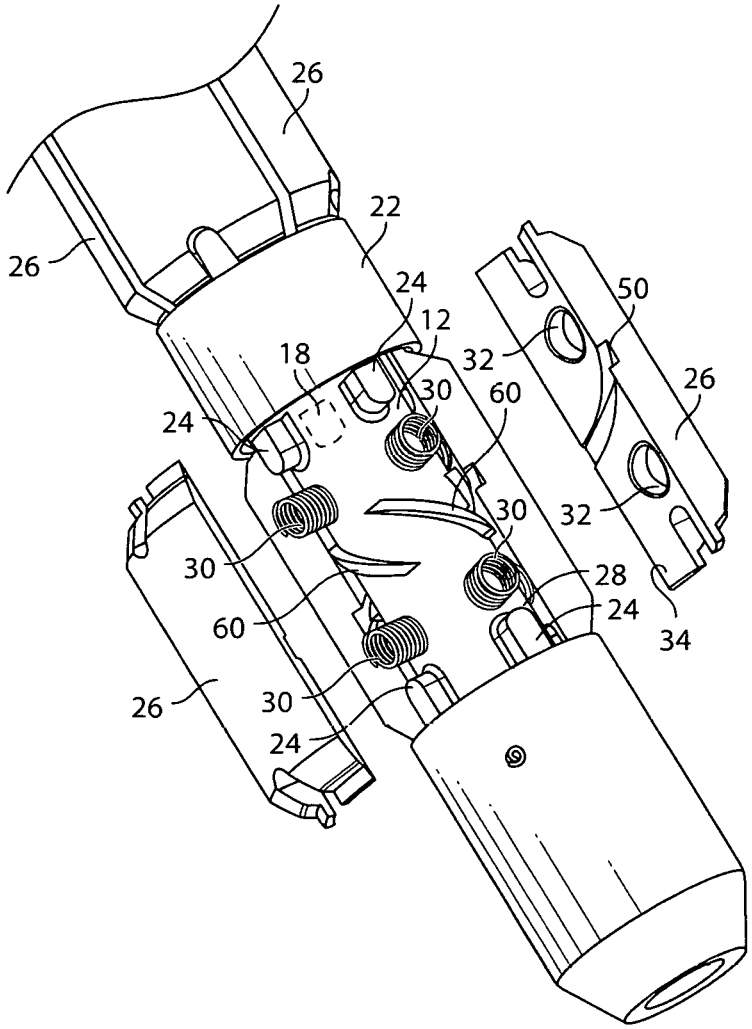
FIG. 3 is an enlarged representation of the lower portion of the exploded perspective view of the plunger assembly shown in FIG. 1.
Figure 4:
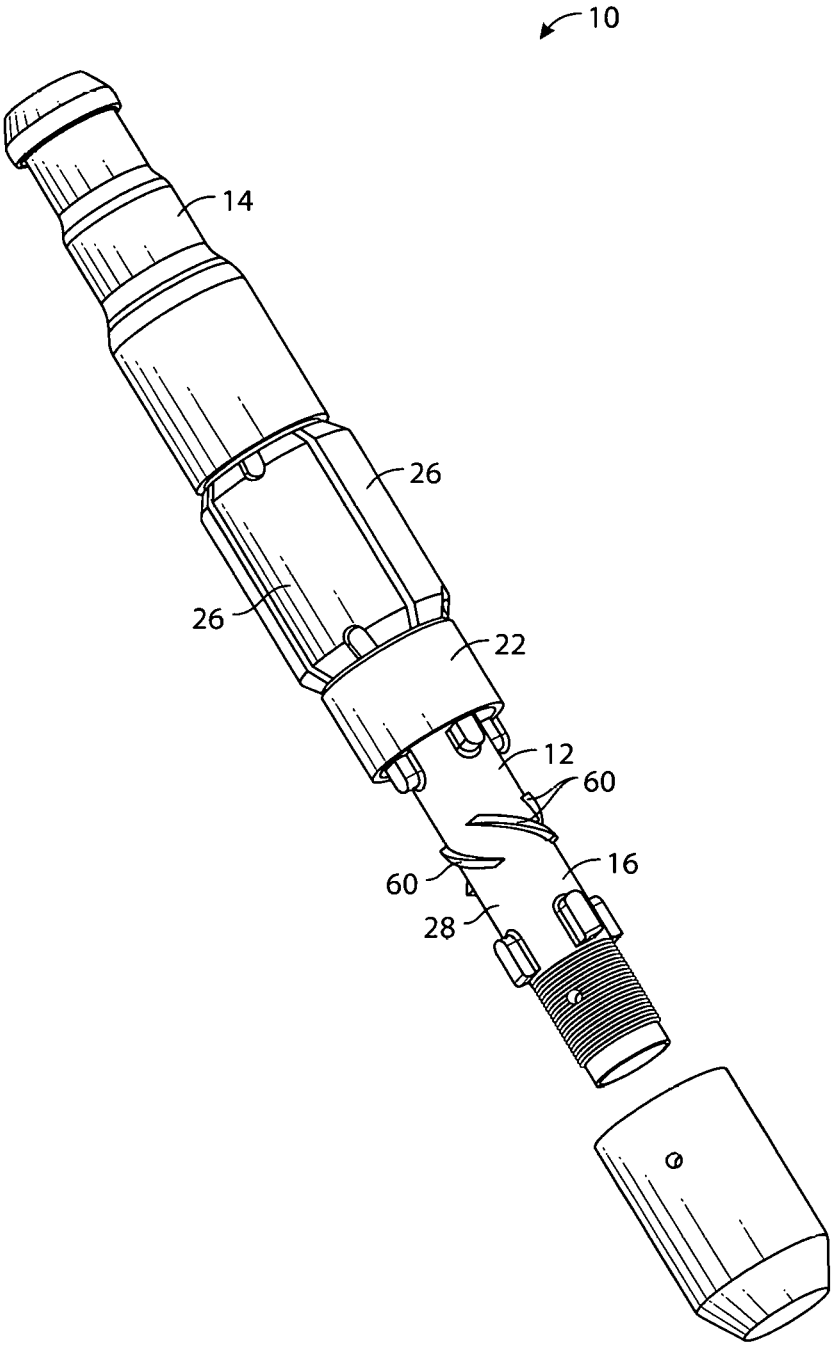
FIG. 4 is a perspective view of a portion of the plunger assembly shown in FIG. 1.

The plunger pads 26 are of course of curvilinear shape so as to conform to the outer surface 28 of the mandrel 12, as represented in FIGS. 1, 3 and 4. The plunger pads 26 are secured by longitudinally annular members as identified and shown in the aforementioned U.S. Pat. No. 9,121,269, incorporated herein by reference. A compressive spring 30 is positioned between the spring pocket 32 and the inner surface 34 of each respective plunger pad 26 at the locus of the spring pocket 32, as represented in FIGS. 1, 2 and 3.

In one preferred embodiment of the plunger assembly of the present invention, the mandrel has a bore 18 extending from the 2nd or lower end 16 to the 1st or upper end 14 as represented in FIG. 2. The bore 18 in the most preferred embodiment has the reduced diameter portion 20 arranged close to the neck on its uppermost end 14. The bore 18 in this embodiment has a rifling groove 40 extending on its cylindrically shaped inner wall 19 from the 2nd or lowermost end 16 all away through to the 1st or uppermost end 14, as best shown in FIG. 2. This includes the portion of the bore with the reduced diameter 20 near the uppermost end 14.

A plurality of radially directed holes or bores 44 in a further embodiment, may be arranged through the sidewall of the mandrel 12 from the bore 18 at the reduced diameter portion 20 thereof as represented in FIG. 2. A plurality of tangentially directed holes or bores 46 in yet another embodiment may be arranged through the sidewall of the mandrel 12 from the bore at longitudinally spaced apart locations at the lower or 2nd end 16 of the bore 18, near the midpoint longitudinally of the bore 18, and close to the upper end 14 of the bore 18 approaching the reduced diameter 20 thereof, as represented in FIG. 2. Such tangentially directed holes or bores 46 extend through the wall of the mandrel 12 and not through one of the movable plunger pads 26 attached thereto.

Figure 6:
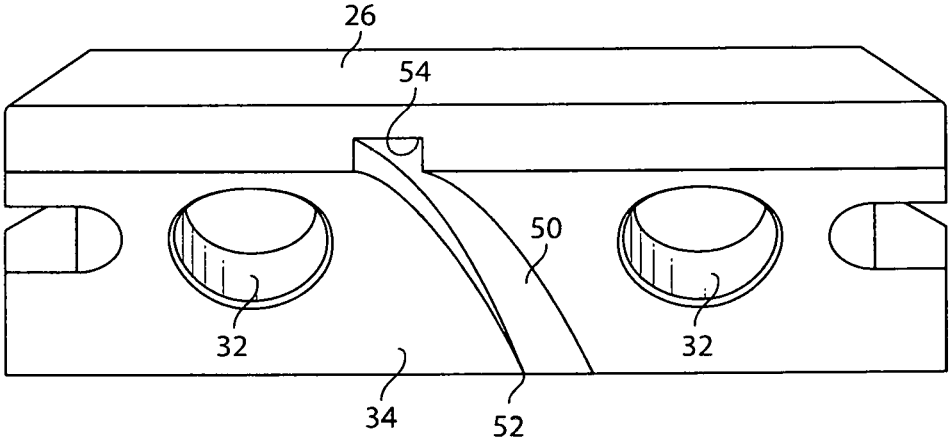
FIG. 6 is a side elevational view of a plunger pad showing a side edge and inner surface thereof representing the cut grooves arranged diagonally thereacross.
Figure 7:
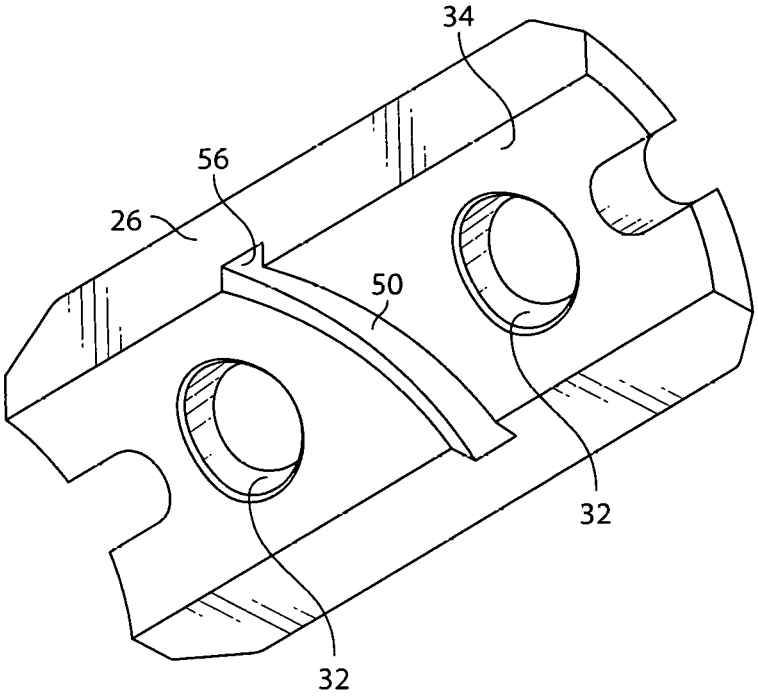
FIG. 7 is a perspective view of the plunger pad shown in FIG. 6 representing the tapered cut grooves on the inner surface thereof.
Figure 8:
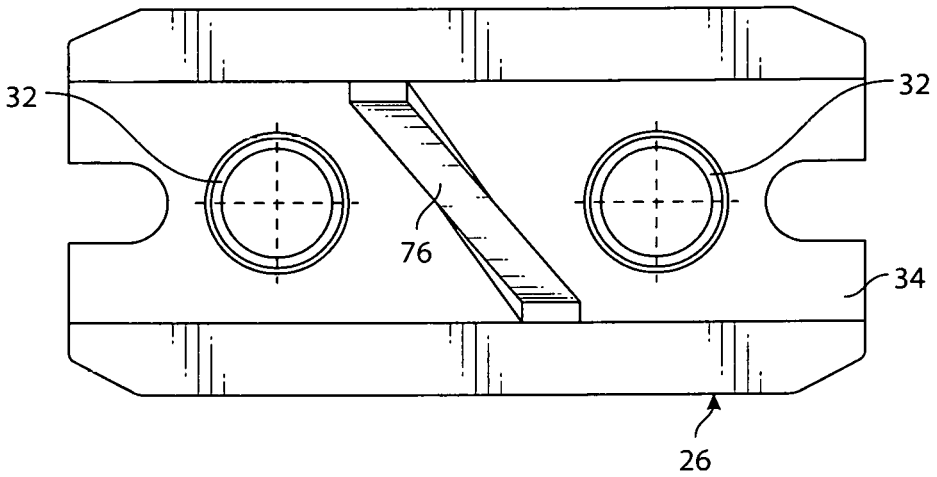
FIG. 8 is a bottom or inside view of a further embodiment of a plunger pad showing a diagonally arranged, tapered, protruding strip thereon.

In one preferred embodiment of the plunger pads 26, there are arranged at least one diagonally disposed groove or cut 50 arranged across the inner curvilinear side 34 thereof as shown in FIGS. 1, 3, 6 and 7. The diagonally disposed groove or cut 50 may be of tapering depth across the length of that groove or cut 50 going from a shallow depth end 52 to a deeper depth end 54 as shown in FIG. 6. FIG. 7 shows a cut 56 of approximately uniform depth along its curvilinear length. Correspondingly, the peripheral outer surface 28 of the mandrel 12 will have an elongated diagonally arranged tapered protrusion 60 thereon, as represented in FIGS. 1, 3, and 4 so as to engage the respective diagonally disposed groove or cut 54 or 56 on its adjacent plunger pad 26, as represented in FIGS. 1 and 3. The purpose of these diagonally arranged protrusions 60 and cuts 50 is to further induce rotation of the plunger assembly 10 about its longitudinal axis "L" as the plunger assembly travels through a well by virtue of the fluid within the well engaging and effecting a biasing force on those diagonal members between the pads 26 and the outer surface 28 of the mandrel 12.

Figure 5:
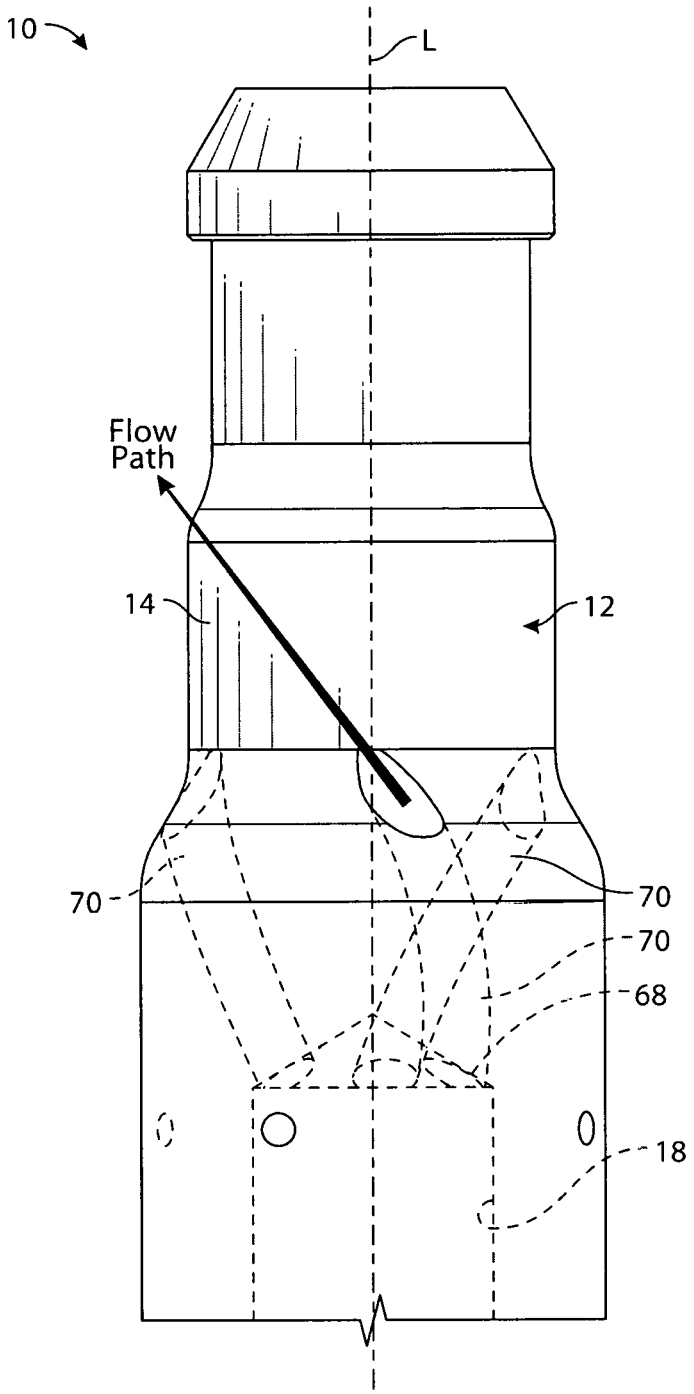
FIG. 5 is a side elevational view of the upper portion of the plunger assembly constructed according to the principles of the present invention, showing an embodiment of angled discharge ports arranged therein.

In yet another embodiment of the present invention, the central bore 18 will have been uppermost end 68 which stops short of the upper end 14 of the mandrel 12, as represented in FIG. 5. In this embodiment however, multiple angled openings or top end bores 70, arranged non-orthogonally but preferably forming a helix extend from the uppermost end of the central bore 18 and out through the wall of the mandrel 12 in a direction towards the upper end 14 of the plunger assembly 10.

The grooves or cuts arranged on the inner-mandrel-facing side 34 of the plunger pads 26 may be of constant depth 56 shown in FIG. 7, or the cuts 50 may be of tapering depth 52/54, as shown in FIG. 6, and correspondingly arranged so to align with the radially adjacent spiral or helically or diagonally arranged correspondingly sized protrusions on the radially outer surface 28 of the mandrel 18 as represented in FIG. 2.

Figure 9:
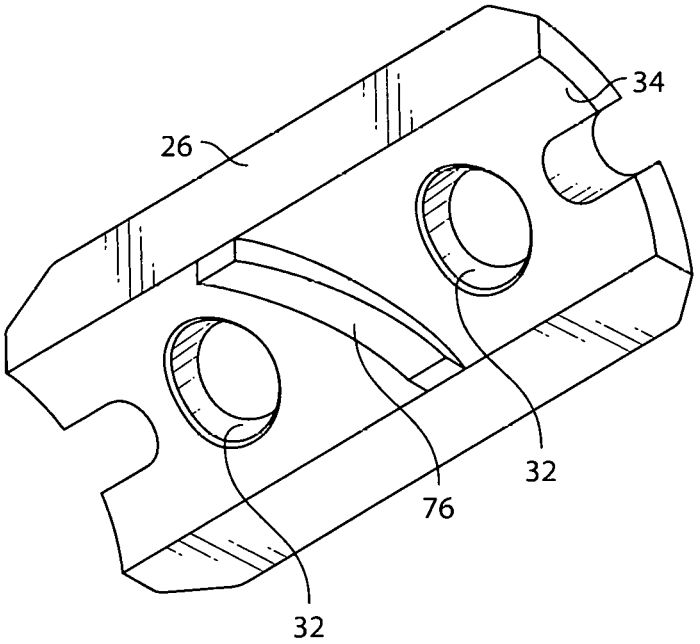
FIG. 9 is a perspective view of the further embodiment of the plunger pad shown in FIG. 8 showing the diagonally arranged, tapered protruding strip on the innermost surface thereof in a somewhat clearer presentation.

In yet a further embodiment of the present invention, the plunger pads 26 themselves may have diagonally or helically arranged elongated angled protrusions 76 extending radially outwardly from the inner surface 34 of the respective pads 26, as shown in FIG. 9. Those angled protrusions 76 on the pads 26 may be of the uniform height or may be of tapering height. The radially adjacent outer surface 28 of the mandrel 18 to which those particular plunger pads 26 would be attached would have a corresponding diagonally or helically arranged cuts of corresponding depth, not shown for clarity of the figures, so as to properly mate with their radially adjacent plunger pads 26.

The invention claimed is:

1. A plunger assembly arranged to minimize uneven wear spots or areas thereon during the plunger assembly's horizontal and vertical travel within a hydrocarbon producing well conduit, the plunger assembly comprising:

an elongated central mandrel having a bore extending longitudinally therethrough for transmitting fluids from a well through the plunger assembly, the elongated central mandrel having a generally cylindrically shaped outer surface portions thereon;

a plurality of arcuately shaped wear pads having an inner mandrel-adjacent side, the wear pads being guidedly supported on and positioned radially adjacent and spaced apart from the cylindrically shaped outer portions of the elongated central mandrel; and an array of elongated helically presented protrusions of tapering height along their length and a corresponding array of elongated helically presented grooves of tapering depth along their length, the protrusions and the grooves being in mating interdigitation between the outer surface portions of the mandrel and the spaced-apart inner mandrel-adjacent surface of the radially adjacent wear pads, so as to provide a fluid-flow inducement of rotation to the plunger assembly about its longitudinal axis during the plunger assembly's travel through a well conduit.

2. The plunger assembly as recited in claim 1, wherein the array of protrusions are arranged on the outer portions of the mandrel, and the corresponding array of grooves are arranged on the radially adjacent wear pads.

3. The plunger assembly as recited in claim 1, wherein the array of protrusions are arranged on the wear pads, and the corresponding array of grooves are arranged on the outer portions of the mandrel.

4. The plunger assembly as recited in claim 1, wherein the elongated protrusions and the elongated grooves have corresponding physical intermatable characteristics along their length.

5. A method of inducing rotation of a plunger assembly during the plunger assembly's movement through a conduit in a hydrocarbon well, comprising:

arranging an elongated central mandrel having a bore extending longitudinally therethrough for transmitting gaseous fluids from a well through the plunger assembly, the elongated central mandrel having an outer wall with cylindrically shaped outer portions arranged longitudinally therealong;

arranging a plurality of arcuately shaped wear pads guidably supported on outer portions of the elongated central mandrel;

arranging a plurality of elongated helically configured protrusions of tapering height along their length and a plurality of elongated helically configured grooves of tapering depth along their length in an intermating relationship between the wear pads and the cylindrically shaped outer portions of the elongated central mandrel to effect a biasing force thereon as fluid flows between the mandrel and wear pad so as to induce that rotation of the plunger assembly.

6. The method of inducing rotation of the plunger assembly as recited in claim 5, including:

arranging the elongated helically configured protrusions on an inner surface of the wear pad.

7. The method of inducing rotation of the plunger assembly as recited in claim 5, including:

arranging the elongated helically configured grooves on the cylindrically outer portion of the elongated mandrel.

8. The method of inducing rotation of the plunger assembly as recited in claim 5, including:

arranging a helically directed groove along a surface of the entire length of the longitudinally directed central bore.

9. A plunger assembly arranged to minimize uneven wear spots or areas thereon during the plunger assembly's horizontal and vertical travel within a hydrocarbon producing well conduit, the plunger assembly comprising:

an elongated central mandrel having an elongated central bore extending longitudinally therethrough for transmitting fluids from a well through the plunger assembly, the elongated central mandrel having a generally cylindrically shaped outer surface along portions thereof;

a plurality of arcuately shaped wear pads guidedly supported on and spaced-apart from the cylindrically shaped radially adjacent the outer portions of the central mandrel;

an array of elongated helically presented protrusions of tapering height along their length and a corresponding array of elongated helically presented grooves of tapering depth along their length in mating interdigitation between the outer portions of the mandrel and the wear pads, so as to provide an inducement of rotation to the plunger assembly about its longitudinal axis during the plunger assembly's travel through a well conduit; and a wall-located helical groove arranged along the entire length of the elongated central bore, to further induce rotation of the plunger assembly about its longitudinal axis as fluid flows through that elongated central bore during travel of the plunger assembly through a well conduit.

10. The plunger assembly as recited in claim 9, wherein the protrusions arranged between the outer surface of portions of the mandrel and the radially adjacent spaced-apart wear pads create a plunger assembly rotation inducing fluid flow path therebetween.

* * * * *